US010806311B2

(12) United States Patent
Lattig

(10) Patent No.: US 10,806,311 B2
(45) Date of Patent: Oct. 20, 2020

(54) PORTABLE COMMODE AID

(71) Applicant: Eugene J. Lattig, Easton, PA (US)

(72) Inventor: Eugene J. Lattig, Easton, PA (US)

( * ) Notice: Subject to any disclaimer, the term of this patent is extended or adjusted under 35 U.S.C. 154(b) by 49 days.

(21) Appl. No.: 16/253,826

(22) Filed: Jan. 22, 2019

(65) Prior Publication Data

US 2019/0328187 A1 Oct. 31, 2019

Related U.S. Application Data

(60) Provisional application No. 62/662,920, filed on Apr. 26, 2018.

(51) Int. Cl.
*A47K 17/02* (2006.01)
*A61G 7/10* (2006.01)

(52) U.S. Cl.
CPC ..... *A47K 17/028* (2013.01); *A47K 17/026* (2013.01); *A61G 7/1007* (2013.01)

(58) Field of Classification Search
CPC .... A47K 12/026; A47K 12/028; A47K 11/04; A61G 7/1007
USPC ..... 135/67; 4/254, 667; 297/423.11; D6/330
See application file for complete search history.

(56) References Cited

U.S. PATENT DOCUMENTS 2,318,416 A * 5/1943 Peirce ..... A47C 16/04 182/129
2,529,532 A * 11/1950 Abbott ..... A47C 1/06 297/256
2,607,926 A * 8/1952 De Puy ..... A47C 12/02 4/254
2,872,686 A * 2/1959 Osborn ..... A61M 3/0225 4/420
2,903,714 A * 9/1959 Grondona ..... A47K 17/026 4/254
3,011,179 A * 12/1961 Hussey ..... A47K 17/026 4/254
3,232,251 A * 2/1966 Hughes ..... A61H 3/00 108/50.16
3,383,714 A * 5/1968 Minasian ..... A47K 17/028 4/254
3,596,668 A * 8/1971 Tosto ..... A61H 3/00 135/67

(Continued)

FOREIGN PATENT DOCUMENTS

CN 107794987 A 3/2018
GB 2196243 A * 4/1988 ..... A61H 3/00

(Continued)

*Primary Examiner* — Robert Canfield
(74) *Attorney, Agent, or Firm* — Fox Rothschild LLP

(57) ABSTRACT

Disclosed herein is a commode aid for providing support to a user when the user leans over a toilet. The commode aide includes: (1) a front leg assembly including a left front leg and a right front leg; (2) a rear leg assembly including a left rear leg and a right rear leg; (3) a left armrest and a right armrest, wherein said left armrest is attached to the left front leg and the left rear leg and said right armrest is attached to the right front leg and the right rear leg; and (4) a horizontal support brace removably mounted to the left front leg and the right front leg, configured to be positioned between a toilet seat and a toilet tank and to provide support for the front leg assembly of the commode aid.

20 Claims, 15 Drawing Sheets

(56) References Cited

U.S. PATENT DOCUMENTS 3,619,820 A * 11/1971 Cain et al. ..... A47K 17/026 4/254
4,534,072 A * 8/1985 Lipski ..... G09B 19/0076 4/235
D287,074 S * 12/1986 Ritchie ..... D6/330
4,635,303 A * 1/1987 Shih ..... A47K 13/06 4/235
4,700,730 A * 10/1987 Samuelson ..... A61H 3/04 135/67
4,722,356 A * 2/1988 Rehder ..... A61H 3/00 135/67
4,850,069 A * 7/1989 Harper ..... A47C 16/04 5/657
4,894,871 A * 1/1990 Schmerler ..... A47K 17/026 135/67
4,995,412 A * 2/1991 Hirn ..... A61H 3/00 135/67
4,998,298 A * 3/1991 Mitchell ..... A47K 17/028 182/106
5,086,798 A * 2/1992 Motts ..... A61H 3/00 135/67
5,291,909 A * 3/1994 Skorman ..... A61H 3/00 135/67
5,933,877 A * 8/1999 Wu ..... A47K 17/028 4/239
5,967,544 A * 10/1999 Kanta ..... A47C 9/027 280/47.24
6,030,039 A 2/2000 Essler
6,123,089 A * 9/2000 Fish ..... A61H 3/00 135/67
6,715,161 B1 * 4/2004 Depoe, Jr. ..... A47K 17/026 4/254
6,779,204 B1 8/2004 Ciotic
10,104,976 B1 * 10/2018 Sprague ..... A47C 16/04
10,130,187 B1 * 11/2018 Clark ..... A47C 16/04
D882,050 S * 4/2020 Lattig ..... D23/299
2002/0089227 A1 * 7/2002 Speraw ..... A47C 16/04 297/423.11
2006/0143816 A1 7/2006 Su
2006/0207002 A1 9/2006 Bradshaw et al.
2008/0121258 A1 * 5/2008 Lin ..... A61H 3/00 135/67
2010/0083993 A1 * 4/2010 Vanden Brook ..... A61H 3/00 135/67
2010/0175178 A1 7/2010 Mrugala
2010/0243011 A1 9/2010 Lin
2011/0219529 A1 * 9/2011 Diamond ..... A47K 11/04 4/449
2014/0125037 A1 5/2014 Andersen
2015/0090308 A1 * 4/2015 Bos ..... A61H 3/04 135/67
2015/0113719 A1 * 4/2015 Good ..... A47K 17/028 4/254
2015/0208884 A1 7/2015 Oluwasogo
2016/0287038 A1 10/2016 Nelson

FOREIGN PATENT DOCUMENTS

GB 2270635 A * 9/1992
GB 2427207 A 12/2006
JP 2004267669 A * 9/2004 ..... A47K 17/028

* cited by examiner

PORTABLE COMMODE AID

CROSS-REFERENCE TO RELATED APPLICATIONS

This patent document claims priority under 35 U.S.C. § 119(e) to the U.S. Provisional Patent Application No. 62/662,920, filed Apr. 26, 2018. The patent application identified above is incorporated here by reference in its entirety to provide continuity of disclosure.

FIELD OF THE INVENTION

The present invention relates generally to a commode aid and more specifically to a portable commode aid for providing support to a user during an expelling process.

BACKGROUND OF THE INVENTION

Commode aid ("Com-Aid") is a health equipment device that aids individuals of all ages (e.g., children, adults, elderly) and of various abilities when they are in the process of expelling the contents of their stomach (e.g., vomiting) while during an illness, or perhaps due to a physical condition (e.g., post-operative state, pregnancy, hydrocephalus, cyclic vomiting syndrome) that forces the body to expel the stomach contents while leaning over a toilet.

There are health issues that arise as the individual kneels over the rim of a toilet. For example, since one is holding onto the rim of the toilet, it raises the question of the rim being sanitary or having been recently washed. In some instances, this could be very unhealthy and most unpleasant. Also kneeling can be painful to those who have problems with their knees such as the elderly, those with arthritic knees, those who have had knee surgery, or those who have any type of damage to their knees. Additionally, the individual using the toilet as a receptacle in which to vomit has to perhaps struggle to stand up from this kneeling or bending position as there is nothing to hold on to while attempting to stand up. Even getting into position to vomit, can be difficult as one has to bend his/her knees, bend over into position, and has nothing to hold on to or stabilize oneself while getting into this position.

Accordingly, there remains a need to provide a commode aid for supporting and stabilizing a user during an expelling process while the user leans towards the toilet.

SUMMARY OF THE INVENTION

To meet the above needs, the present disclosure provide a commode aid, which includes: (1) a front leg assembly including a left front leg and a right front leg; (2) a rear leg assembly including a left rear leg and a right rear leg; (3) a left armrest and a right armrest, wherein said left armrest is attached to the left front leg and the left rear leg, and said right armrest is attached to the right front leg and the right rear leg; and (4) a horizontal support brace mounted to the left front leg and the right front leg and configured to be positioned between a toilet seat and a toilet tank and to provide support for the front leg assembly of the commode aid.

In some embodiments, the commode aid also includes a kneepad rotatably attached to the left rear leg and the right rear leg, wherein said kneepad cushions a user's knees when the kneepad is in a horizontal position, and the user is kneeling on the kneepad. In some embodiments, the commode aid additionally includes a rear support bar attached to the left rear leg and the right rear leg, configured to provide support for the rear leg assembly. In some embodiments, the rear support bar includes a kneepad latching station, and the kneepad includes a locking means. In some embodiments, the locking means on the kneepad is configured to engage with the kneepad latching station, such that the kneepad is secured in an upright position when the kneepad is not in use. In some embodiments, the locking means is a latch, a hook, or a magnet. In some embodiments, the kneepad is padded.

In some embodiments, the kneepad can be removably attached to the rear leg assembly. The kneepad may include a concaved recess on each short edge of the kneepad and wherein the shape of the concaved recess substantially matches the convex outer rim of the left or right rear leg, thereby the kneepad is removably attached to the rear leg assembly when it is in use.

In some embodiments, the commode aid further includes a left leg support and a right leg support, respectively positioned the left armrest and the right armrest. Each of the left leg support and the right leg support includes one or more fastening means configured to couple the left front leg and the left rear leg to the left leg support and couple the right front leg and the right rear leg to the right leg support.

In some embodiments, each of the left front leg, the left rear leg, the right front leg, and the right rear leg is adjustable in height. In some embodiments, the horizontal support brace is adjustable in length. In some embodiments, each of the left front leg, the left rear leg, the right front leg, and the right rear leg includes an inner telescopic member and an outer telescopic member. In some embodiments, the inner telescopic member includes an elasticity member having a post and a spring embedded, and the outer telescopic member includes a plurality of holes in the periphery thereof. In some embodiments, the inner telescopic member and the outer telescopic member are aligned such that the post on the inner telescopic member fits through one of the holes on the outer telescopic member.

In some embodiments, the commode aid further includes a left spreader hinge and a right spreader hinge. In some embodiments, the left spreader hinge is configured to connect the left front leg and the left rear leg, and the right spreader hinge is configured to connect the right front leg and the right rear leg, such that the front leg assembly and the rear leg assembly are placed in an open or a closed position.

In some embodiments, the horizontal support brace is substantially U-shaped. In some embodiments, the horizontal support brace also includes a padded portion, which is configured to be positioned between the toilet seat and the toilet tank and to provide support for the front leg assembly of the commode aid. In some embodiments, the horizontal support brace is adjustable in length. In some embodiments, the commode aid further includes a left folding stop attached to the left front leg and a right folding stop attached to the right front leg.

BRIEF DESCRIPTION OF THE DRAWINGS

The foregoing and other objects, features, and advantages of the present disclosure set forth herein will be apparent from the following description of particular embodiments of those inventive concepts, as illustrated in the accompanying drawings. Also, in the drawings, the like reference characters refer to the same parts throughout the different views. The drawings depict only typical embodiments of the present disclosure and, therefore, are not to be considered limiting in scope.

FIG. 13A and FIG. 13B are collectively referred to as FIG. 13.

FIG. 15A and FIG. 15B are collectively referred to as FIG. 15.

DETAILED DESCRIPTION OF THE INVENTION

Figure 1:
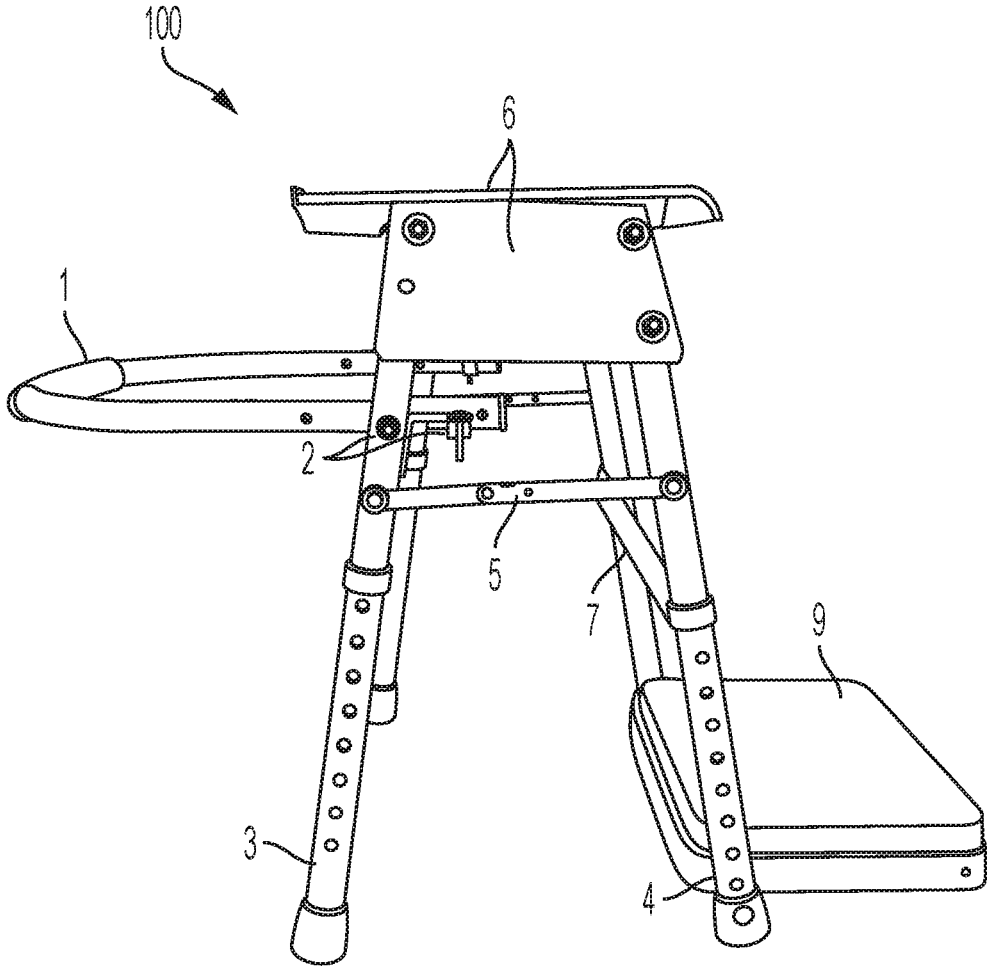
FIG. 1 depicts a side view of an example of a commode aid in an open position.

This disclosure is not limited to the particular systems, methodologies or protocols described, as these may vary. The terminology used in this description is to describe the particular versions or embodiments only and is not intended to limit the scope.

Commode aid is a device that straddles the toilet bowl to provide support to a user who leans towards a toilet bowl. It has two handrails on either side, attached to support legs so the user can hold onto either rail without tipping or losing their balance while attempting to get into position to vomit or when attempting to stand-up. This is especially important for those users such as the elderly, those recovering from surgery, or those weakened for any reason because it gives them something by which to support themselves both while vomiting and as well as while attempting to stand up. It also has a kneeling pad that is comfortably padded as part of the design. Hence the user, while having to endure an unpleasant experience, at least will have his/her knees protected on a soft, comfortable surface. The support legs are adjustable depending on the height needed thus aiding both shorter and taller individuals. Importantly, the commode aid can remain in position even when the toilet is in normal use. Hence the crossbar and the handrails can support the user who has a weak or damaged back or weakened legs by giving them something by which to support themselves. For example, the commode aid can be used as a "toilet safety frame" to aid the user to sit or stand up more easily.

Another issue that can be addressed with the use of the commode aid is the issue of correct or more successful elimination. It has been found that squatting (as opposed to sitting upright on a toilet) helps promote proper, more complete, and easier defecation. Studies have found that increasing the anorectal angle from 100 degrees to 126 degrees from a sit to squat have produced effortless, complete and more timely elimination. The use of the commode aid kneeling pad helps to elevate the feet and knees of the user while he or she is seated on the toilet. Hence the Com-Aid will help the user produce more complete, less time consuming, and more effortless bowel movements.

All parts of the disclosed commode aid are washable and can be sanitized. The kneeling pad can be folded up, secured, or removed and out of the way when not needed. The Com-Aid is designed to be folded flat and stored away when not in use.

The commode aid equipment has a horizontal padded brace that is connected to the front legs by a hinge and rests on the commode between the toilet seat and tank. It serves as a support and stabilizer for the front of commode aid. The horizontal brace is also adjustable from front to back so that Com-Aid can easily be fitted to various size commodes.

Its two front legs and two rear legs are adjustable to accommodate the height of any commode. The commode aid has two armrests/hinges on either side designed to give support while the user gets up or kneels down when using it to expel vomit or get up or down on the commode. The armrests are also adjustable, so the user can adjust them as needed when using the commode in a traditional fashion.

There are two spreader hinges that connect the front and rear legs, allowing the commode aid to collapse. The rear legs are connected by a cross/support bar that acts as a brace to support and strengthen this equipment. The bar also has a latch that serves as a docking port for the kneeling pad in its fold-up position.

The rear legs are also connected to the kneeling pad that cushions the user's knees while in use. In some embodiments, the kneeling pad can also be folded up and connects to the rear cross brace to keep it out of the way. If a person wishes to use commode aid as a support for getting down or up when using the commode for normal use the kneeling pad can be removed completely and stored away by itself. This usage allows Com-aid to be placed in a position to the commode on a more permanent basis. Com-Aid may collapse compactly and folded flat so that it can be easily stored.

Referring to FIG. 1, an exemplary commode aid 100 is illustrated. The commode aid ("Com-Aid") 100 includes: (1) a front leg 3 assembly including a left front leg and a right front leg; (2) a rear leg 4 assembly including a left rear leg and a right rear leg; (3) a left armrest and a right armrest (e.g. 6), wherein said left armrest is attached to the left front leg and the left rear leg and said right armrest is attached to the right front leg and the right rear leg; and (4) a horizontal support brace 1 removably mounted to the left front leg and the right front leg, configured to be positioned between a toilet seat and a toilet tank and to provide support for the front leg assembly of the commode aid 100.

Figure 2:
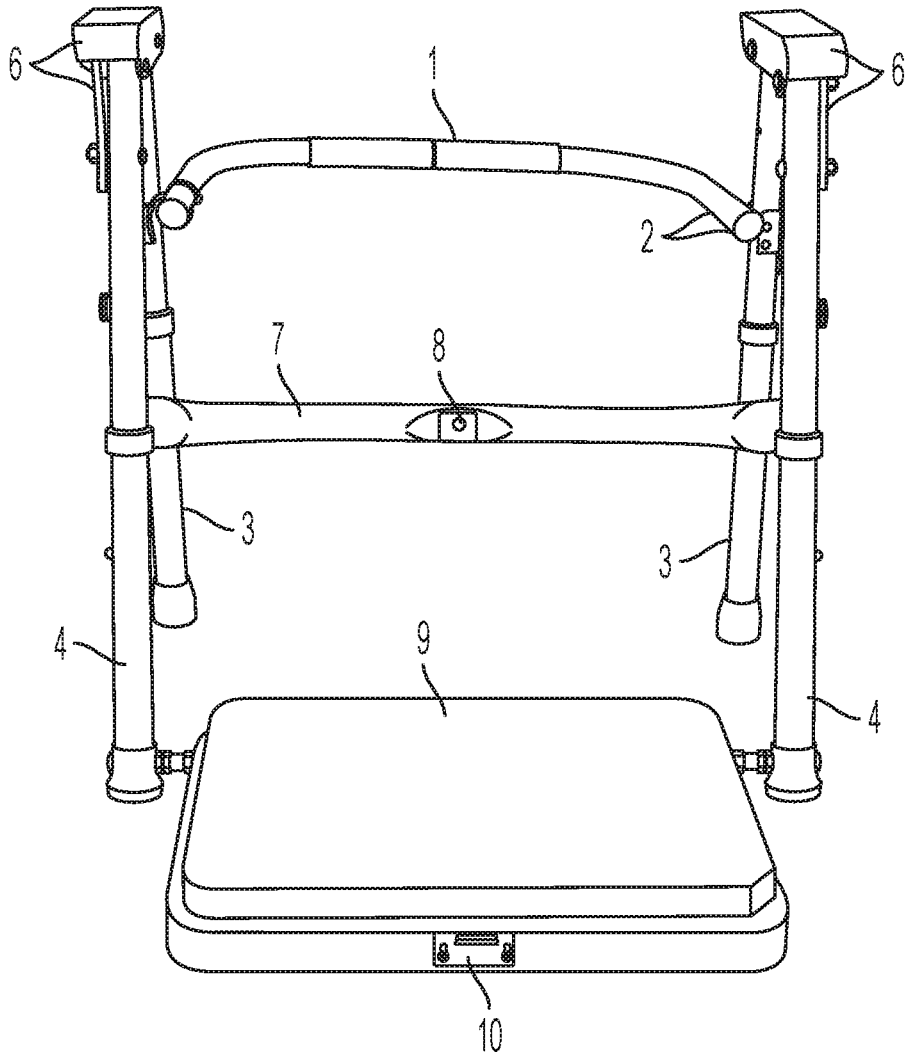
FIG. 2 depicts a front view of an example of a commode aid in an open position.
Figure 3:
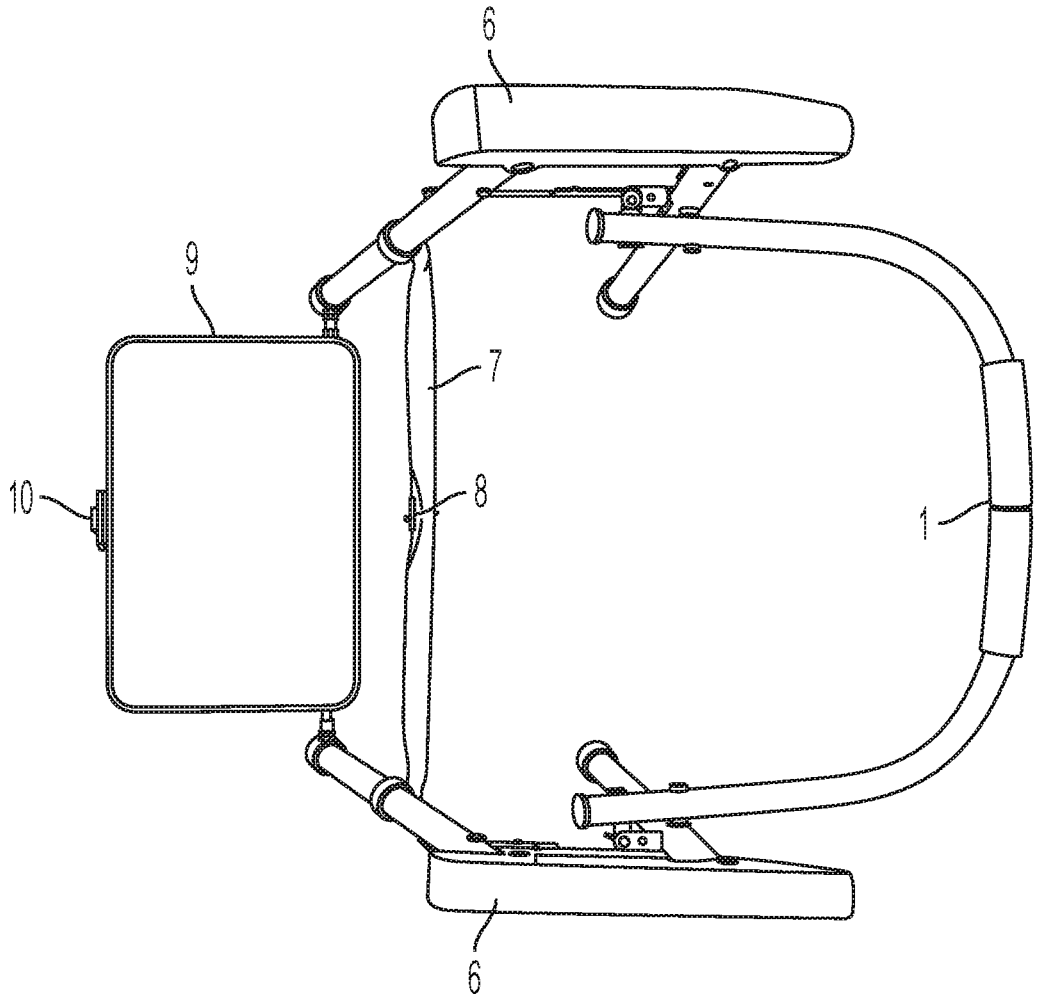
FIG. 3 depicts a top view of an example of a commode aid in an open position.
Figure 4:
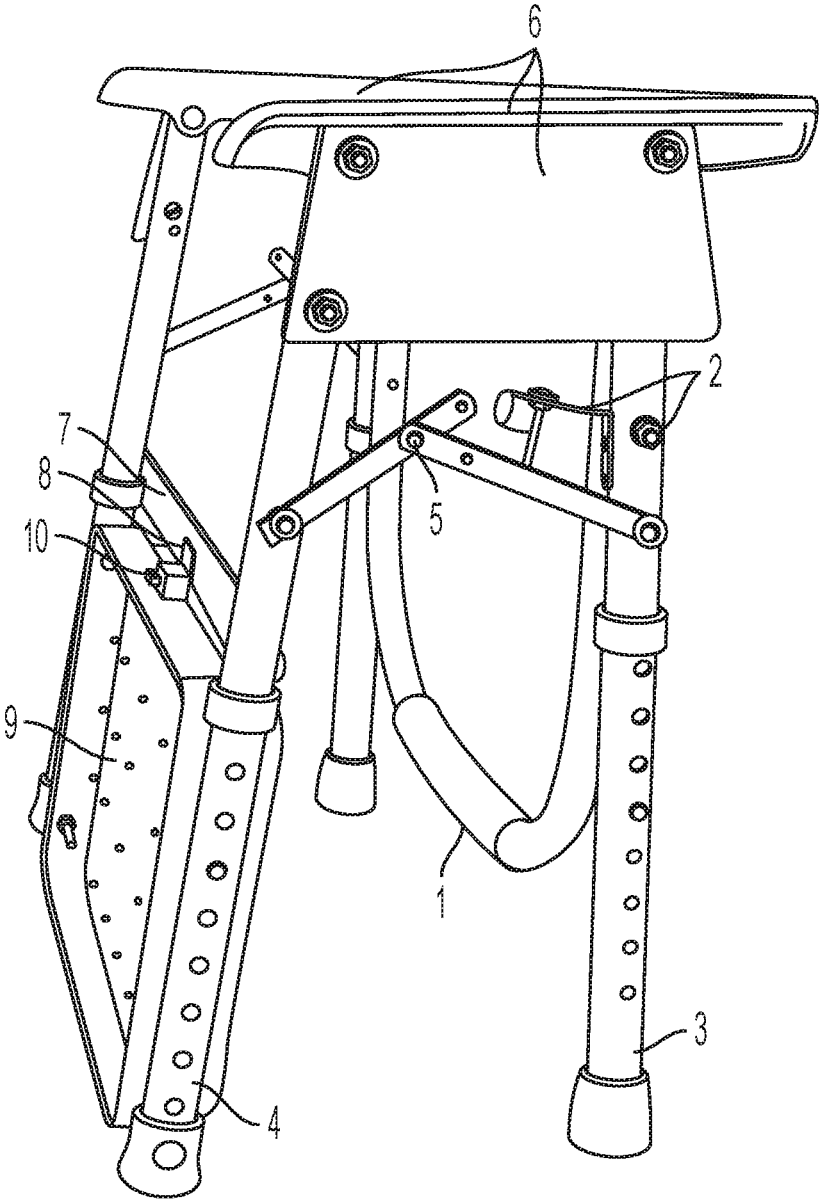
FIG. 4 depicts a side view of an example of a commode aid in a closed position and with the kneepad kept in an upright position.
Figure 5:
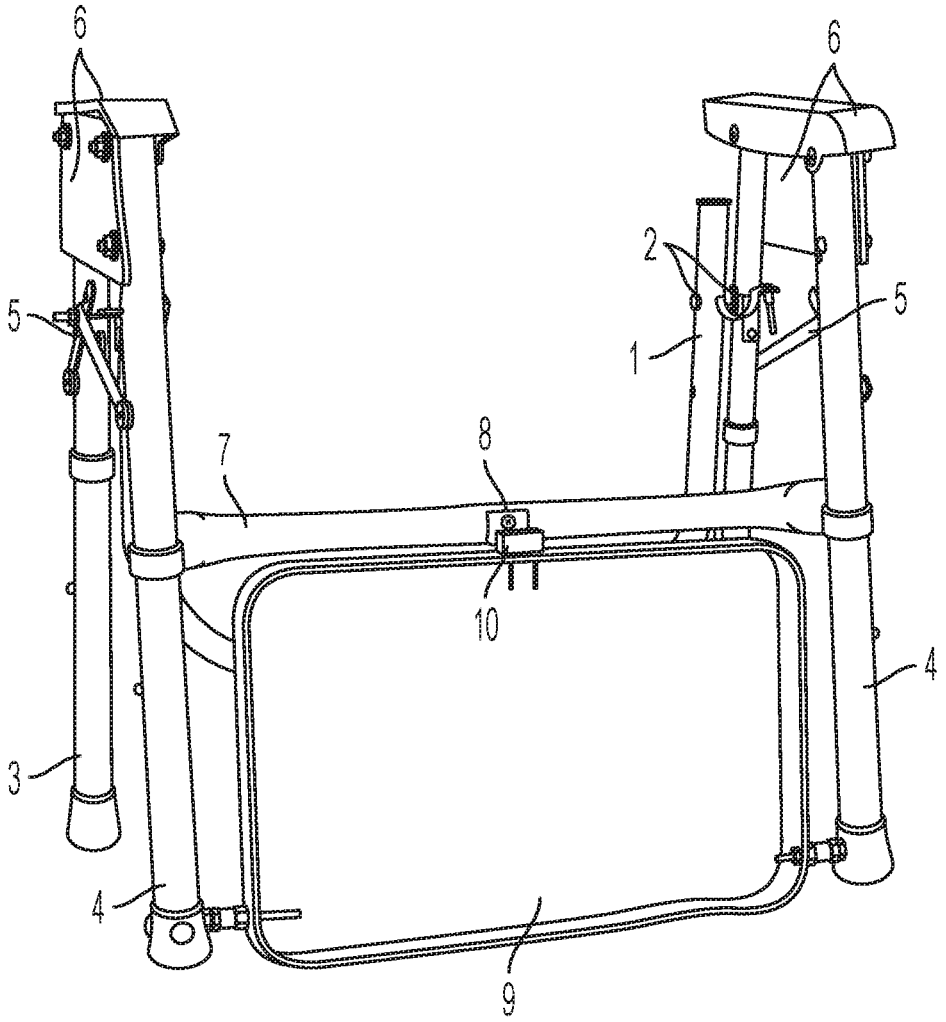
FIG. 5 depicts a front view of an example of a commode aid in a closed position and with the kneepad kept in an upright position.
Figure 6:
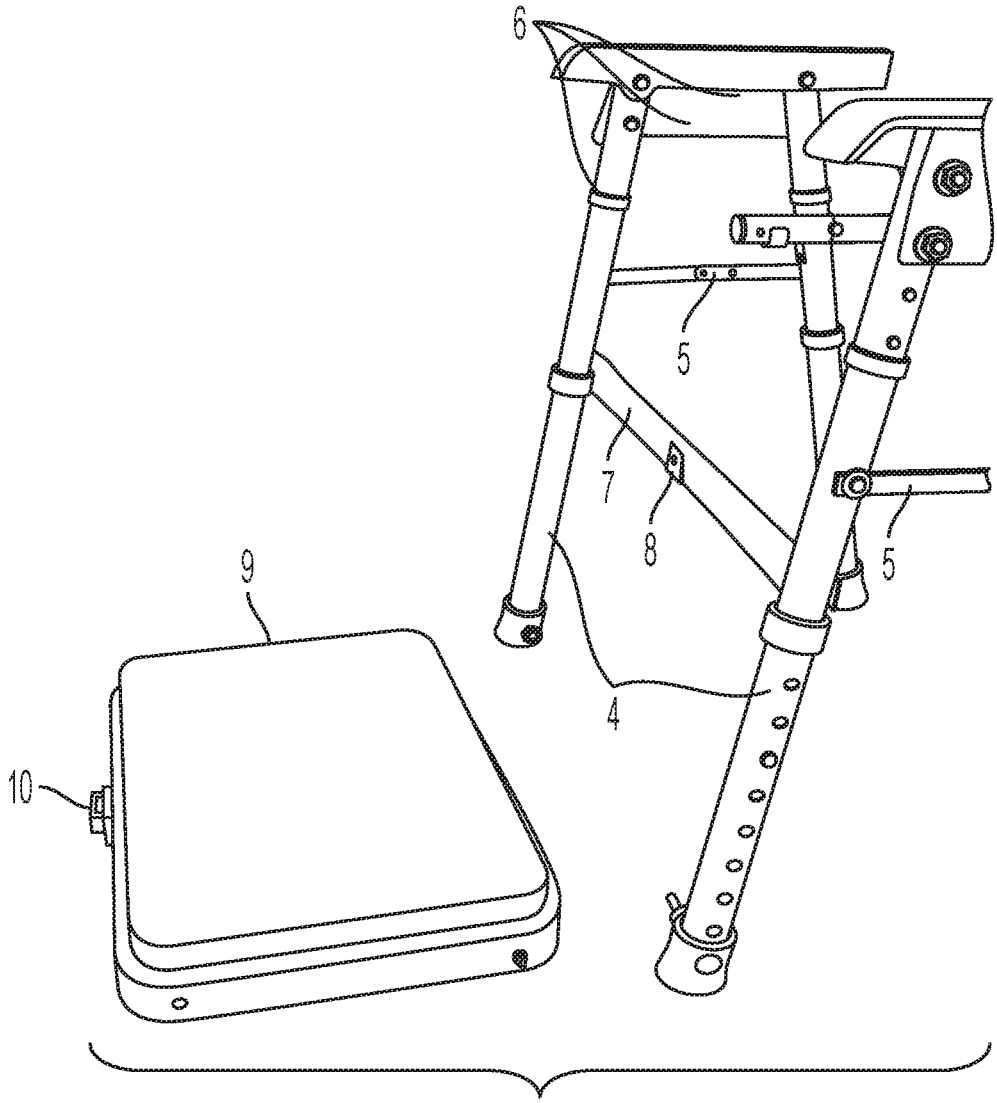
FIG. 6 depicts a side view of an example of a commode aid in an open position with the kneepad detached (kneepad not shown); the horizontal support brace is adjustable in length.
Figure 7:
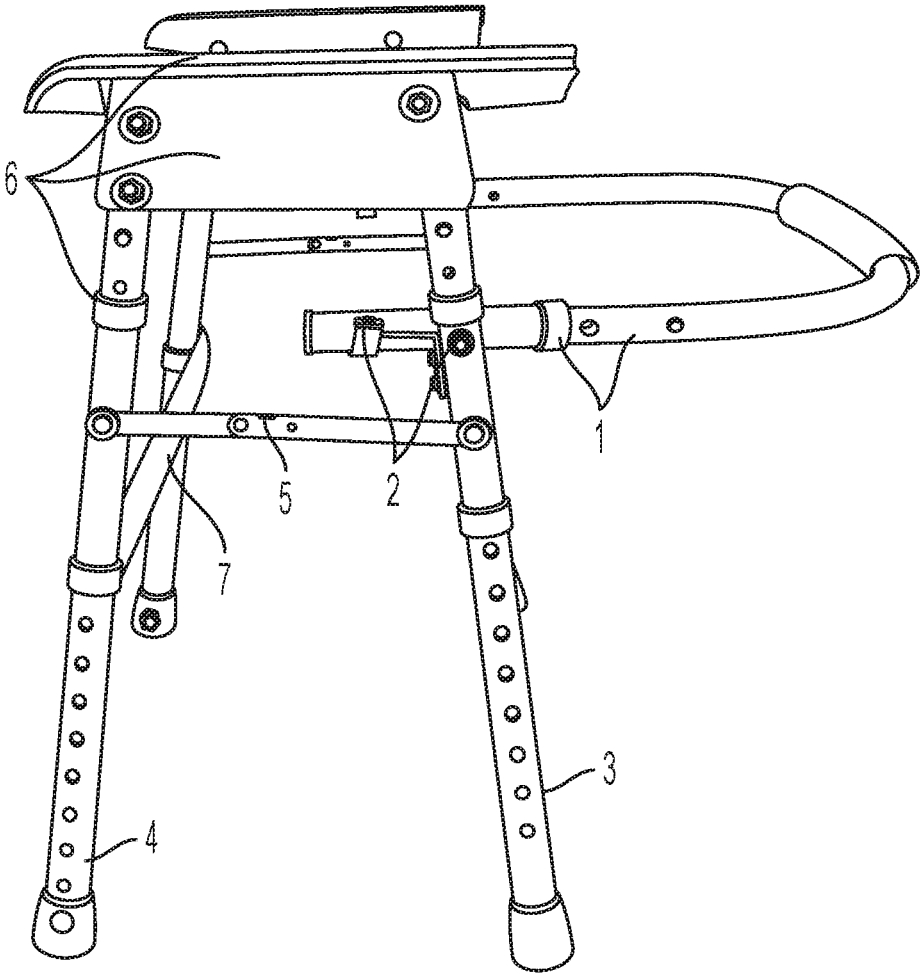
FIG. 7 depicts a side view of an example of a commode aid in an open position, with the kneepad detached.
Figure 8:
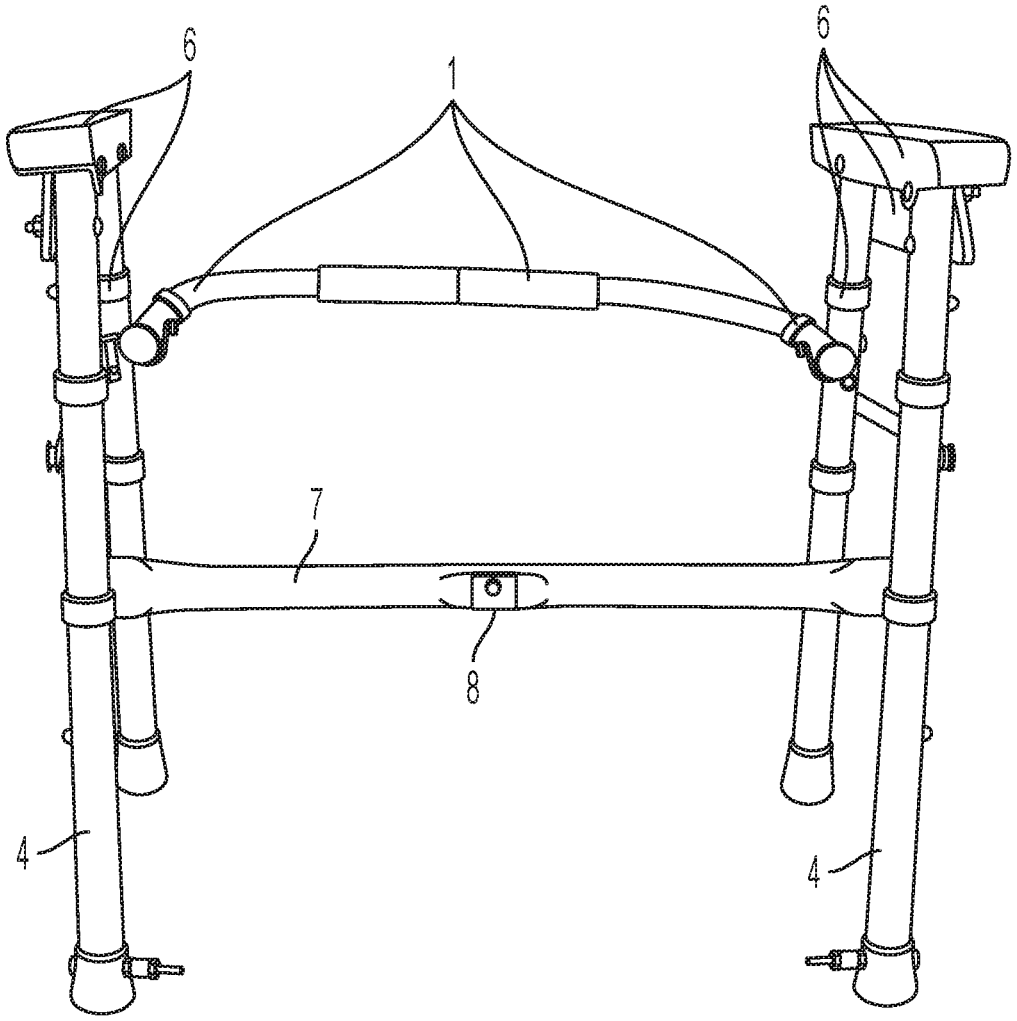
FIG. 8 depicts a front view of an example of a commode aid in an open position, with the kneepad detached (kneepad not shown).
Figure 9:
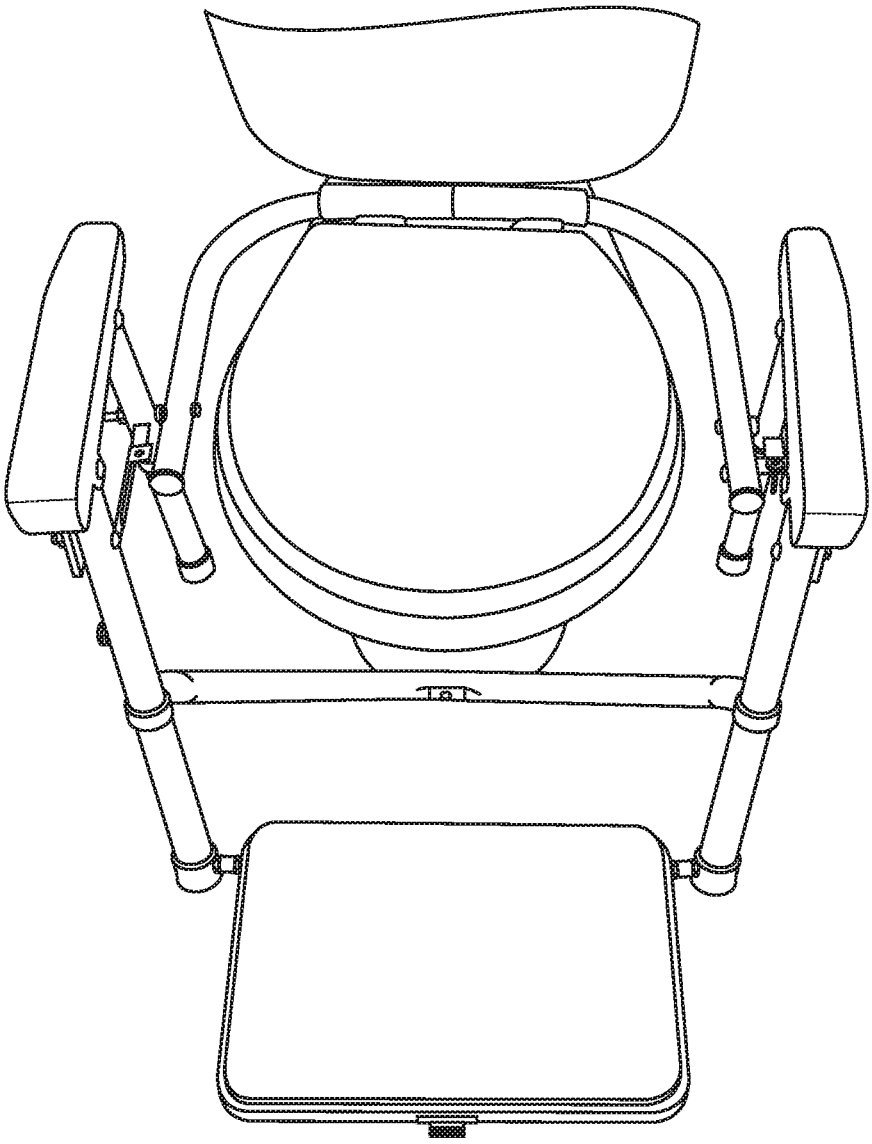
FIG. 9 depicts a front view of an example of a commode aid in an open position that straddles a toilet bowl.
Figure 10:
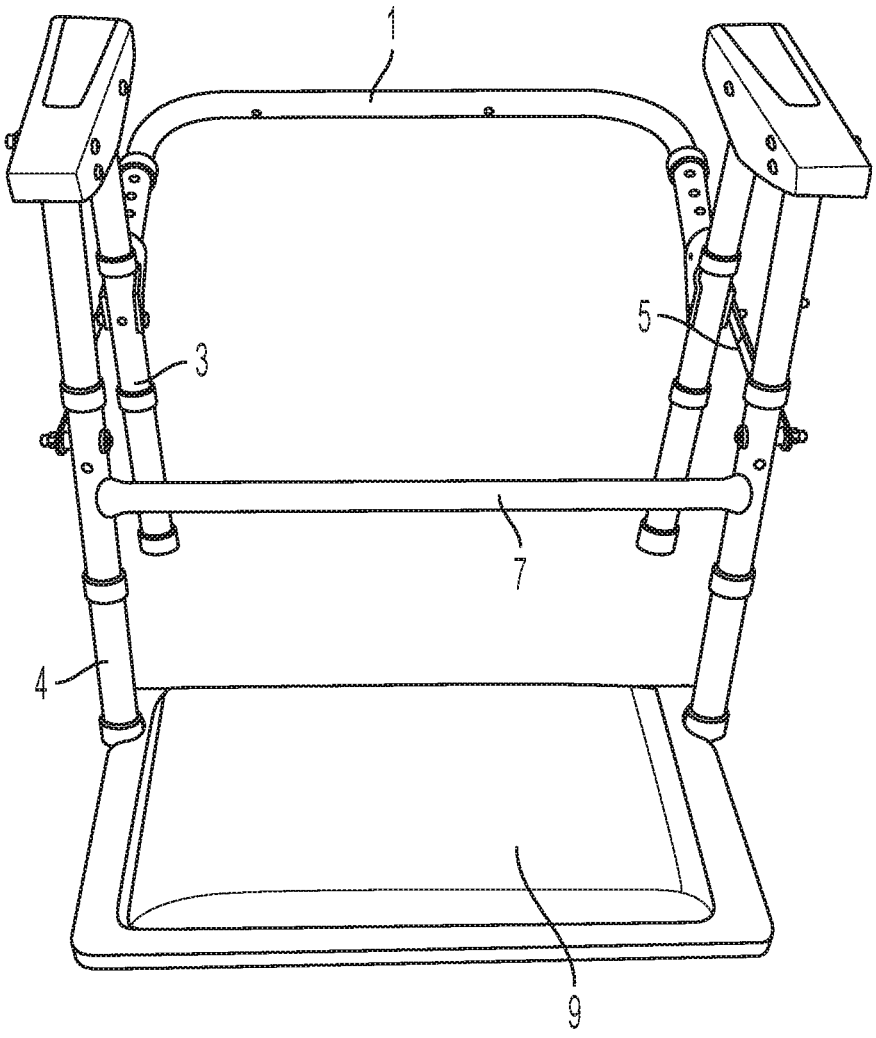
FIG. 10 depicts a front view of an example of a commode aid with a detachable kneepad in an open position.
Figure 11:
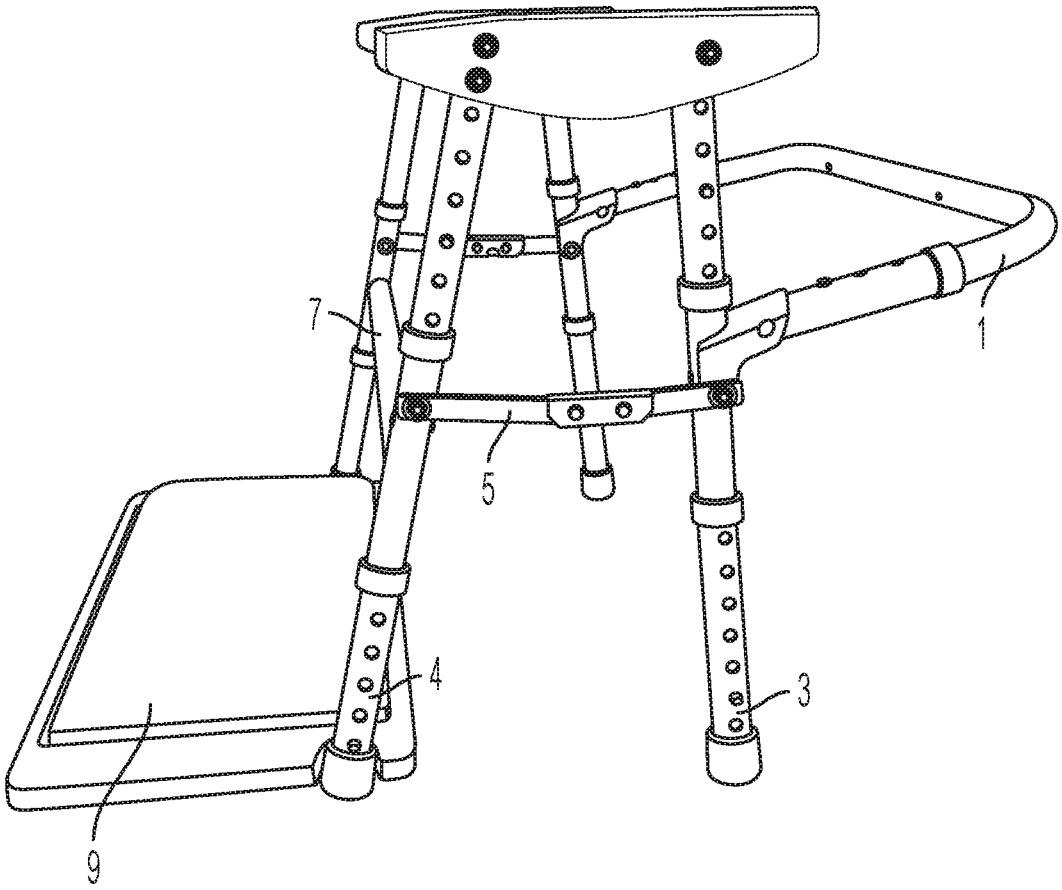
FIG. 11 depicts a side view of an example of a commode aid with a detachable kneepad in an open position.
Figure 12:
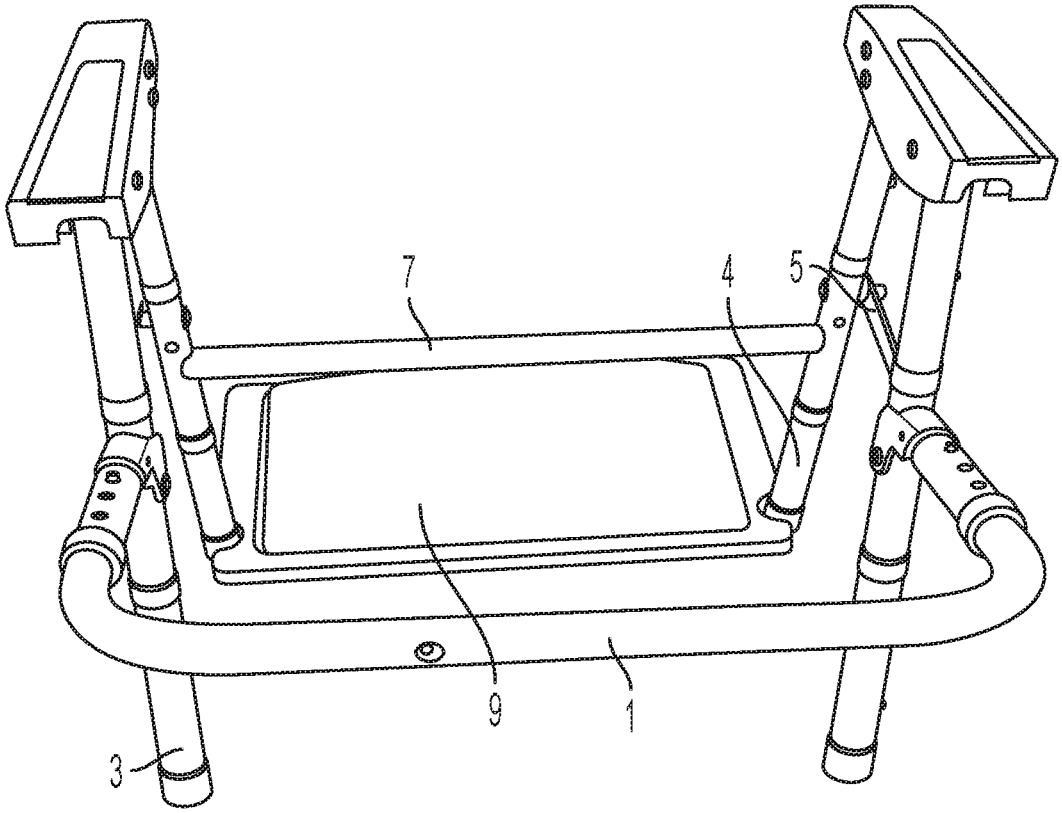
FIG. 12 depicts a rear view of an example of a commode aid with a detachable kneepad in an open position.
Figure 13B:
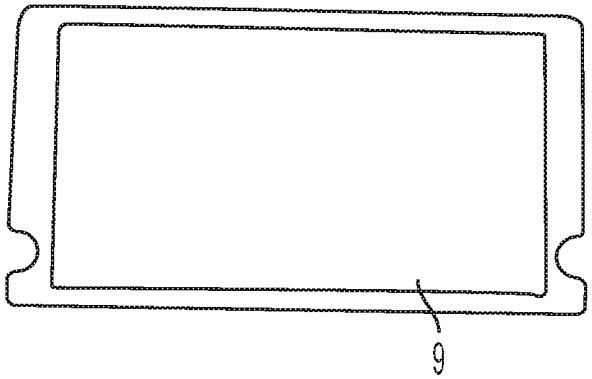
FIG. 13B depicts a top view of an example of the kneepad.
Figure 13A:
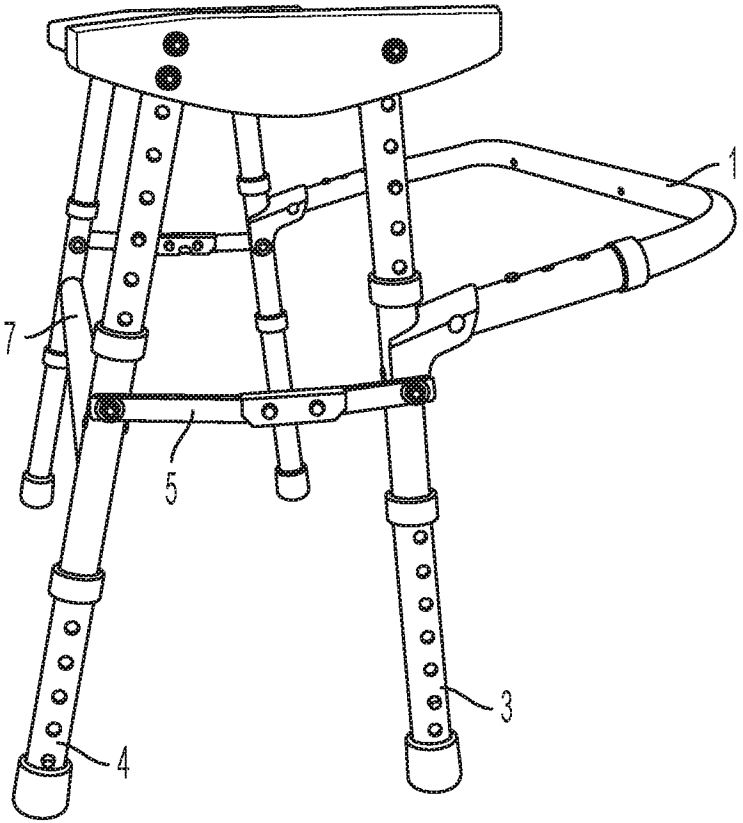
FIG. 13A depicts a side view of an example of a commode aid in an open position with the kneepad detached.

In some embodiments, the commode aid 100 also includes a kneepad 9 rotatably attached to the left rear leg 4 and the right rear leg 4, wherein said kneepad 9 protects knee joints of a user when the kneepad 9 is in a horizontal position, and the user is kneeling on the kneepad, as shown in FIGS. 1-3 and FIG. 9. In some embodiments, the commode aid additionally includes a rear support bar 7 attached to the left rear leg 4 and the right rear leg 4 and configured to provide support for the rear leg assembly (FIG. 1). In some embodiments, the rear support bar 7 includes a kneepad latching station 8, and the kneepad 9 comprises a locking means 10 (FIG. 2). In some embodiments, the locking means on the kneepad is configured to engage with the kneepad latching station 8, such that the kneepad 9 is secured in an upright position when the kneepad is not in use (FIG. 4 and FIG. 5). In some embodiments, the locking means 10 is a latch, a hook, or a magnet. In some embodiments, the kneepad is padded. As shown in FIGS. 6-8, the kneepad can be removed from the rear leg assembly if needed. In such a configuration, the kneepad is kept as a separate part from the commode aid and used if needed.

In some embodiments, the commode aid further includes a left leg support and a right leg support, respectively positioned under the left armrest and the right armrest. Each of the left leg support and the right leg support includes one or more fastening means configured to couple the left front leg and the left rear leg to the left leg support and couple the right front leg and the right rear leg to the right leg support.

In some embodiments, each of the left front leg, the left rear leg, the right front leg, and the right rear leg is adjustable in height (FIG. 1). In some embodiments, each of the left front leg, the left rear leg, the right front leg, and the right rear leg comprises an inner telescopic member and an outer telescopic member. In some embodiments, the inner telescopic member comprises an elasticity member having a post and a spring embedded, and the outer telescopic member comprises a plurality of holes in the periphery thereof. In some embodiments, the inner telescopic member and the outer telescopic member are aligned such that the post on the inner telescopic member fits through one of the holes on the outer telescopic member. Similarly, in some embodiments, the horizontal support brace 1 is adjustable in length, as shown FIG. 6 and FIG. 7. The horizontal support brace 1 includes an inner telescopic member and an outer telescopic member. In some embodiments, the inner telescopic member comprises an elasticity member having a post and a spring embedded, and the outer telescopic member comprises a plurality of holes in the periphery thereof. In some embodiments, the inner telescopic member and the outer telescopic member are aligned such that the post on the inner telescopic member fits through one of the holes on the outer telescopic member. In some embodiments, the armrest assembly including the armrests and the leg supports are also adjustable in height. In an example as shown in FIG. 6, each of the front left leg, the front right leg, the rear left leg, and the rear right leg further includes an inner telescopic member and an outer telescopic member. In some embodiments, the inner telescopic member comprises an elasticity member having a post and a spring embedded, and the outer telescopic member comprises a plurality of holes in the periphery thereof. In some embodiments, the inner telescopic member and the outer telescopic member are aligned such that the post on the inner telescopic member fits through one of the holes on the outer telescopic member.

In some embodiments, the commode aid further includes a left spreader hinge 5 and a right spreader hinge 5. In some embodiments, the left spreader hinge is configured to connect the left front leg and the left rear leg, and the right spreader hinge is configured to connect the right front leg and the right rear leg, such that the front leg assembly and the rear leg assembly are placed in an open or a closed position.

In some embodiments, the horizontal support brace 1 is substantially U-shaped. In some embodiments, the horizontal support brace 1 also includes a padded portion, which is configured to be positioned between the toilet seat and the toilet tank and to provide support for the front leg assembly of the commode aid. In some embodiments, the horizontal support brace is adjustable in length. In some embodiments, the commode aid further includes a left folding stop 2 attached to the left front leg and a right folding stop 2 attached to the right front leg.

Figure 14:
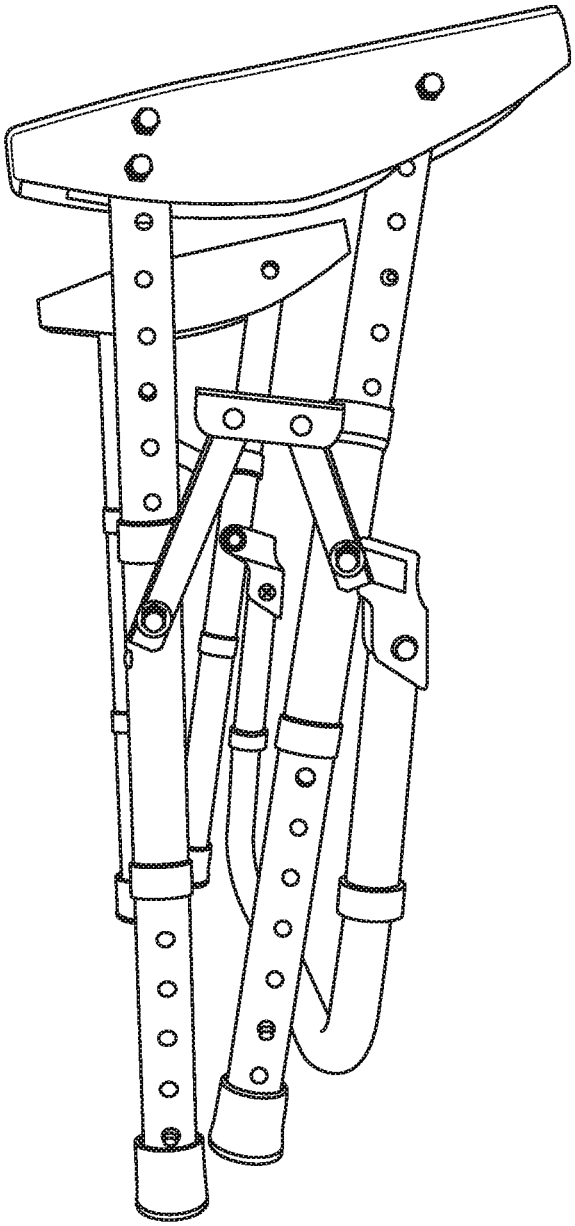
FIG. 14 depicts a side view of an example of a commode aid as shown in FIG. 13A, in a closed position with the kneepad detached.
Figure 15B:
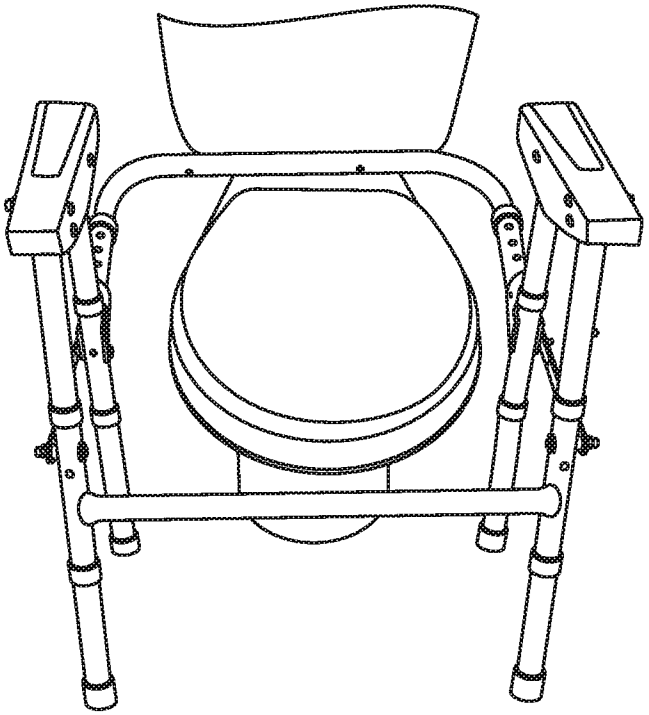
FIG. 15B depicts a perspective view of an example of a commode aid in an open position (with the kneepad detached) that straddles a toilet bowl.
Figure 15A:
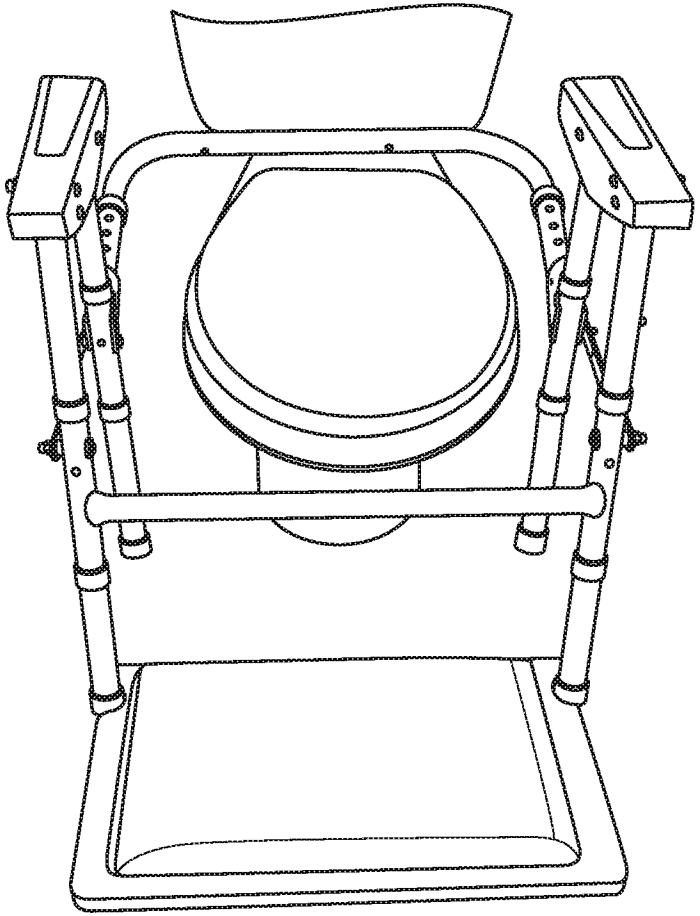
FIG. 15A depicts a perspective view of an example of a commode aid with a detachable kneepad in an open position that straddles a toilet bowl.

FIGS. 10-15 show an example of commode aid with a detachable kneepad. Distinguishable from the commode aid shown in FIG. 1 where the kneepad is mounted to the rear legs through one or more screws, the kneepad of the commode aid as in FIGS. 10-15 includes a recess on each short edge of the kneepad (see FIG. 13B). The concaved shape of the recess substantially matches the convex outer rim of the rear legs. When the kneepad is in use, the concaved recess of the kneepad is engaged with one of the rear legs, such that the kneepad can be positioned on the rear side the commode aid remains stationary when the user kneels on it. Because the kneepad is not mounted to the rear legs via screws, it can be conveniently detached (FIGS. 13A and 13B). For example, when the commode aid is used to provide support for the user to stand up or sit down, the kneepad is not necessary and can be put away easily. As with the commode aid shown in FIG. 1, when the commode aid is not in use, the commode aid shown in FIGS. 10-15 can also be folded to save space or for storage (FIG. 14).

The use of the word "a" or "an", when used in conjunction with the term "comprising" in the claims and/or the specification, may mean "one," but it is also consistent with the meaning of "one or more," "at least one," and "one or more than one."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Other objects, features, and advantages of the present invention will become apparent from the following detailed description. It should be understood, however, that the detailed description and the examples, while indicating specific embodiments of the invention, are given by way of illustration only. Additionally, it is contemplated that changes and modifications within the spirit and scope of the invention will become apparent to those skilled in the art from this detailed description.

What is claimed is:

1. A commode aid, comprising:

a front leg assembly comprising a left front leg and a right front leg;

a rear leg assembly comprising a left rear leg and a right rear leg;

a left armrest and a right armrest, wherein the left armrest is attached to the left front leg and the left rear leg and the right armrest is attached to the right front leg and the right rear leg;

a horizontal support brace mounted to the left front leg and the right front leg, configured to be positioned between a toilet seat and a toilet tank and to provide support for the front leg assembly of the commode aid; and a knee support, configured to provide protection to knee joints of a user when the knee support is in a horizontal position, wherein the knee support comprises two opposing short edges and two opposing long edges, each of the two opposing short edges comprising a concaved recess, and wherein the shape of the concaved recess substantially matches a convex outer rim of the left or right rear leg, thereby the knee support is removably attached to the rear leg assembly.

2. The commode aid of claim 1, wherein the knee support is padded.

3. The commode aid of claim 1, further comprising a left leg support and a right leg support, respectively positioned under the left armrest and the right armrest, wherein each of the left leg support and the right leg support comprises one or more fastening means configured to couple the left front leg and the left rear leg to the left leg support and couple the right front leg and the right rear leg to the right leg support.

4. The commode aid of claim 1, wherein each of the left front leg, the left rear leg, the right front leg, and the right rear leg is adjustable in height.

5. The commode aid of claim 1, wherein the horizontal support brace is adjustable in length.

6. The commode aid of claim 1, wherein each of the left front leg, the left rear leg, the right front leg, and the right rear leg comprises an inner telescopic member and an outer telescopic member, wherein:

the inner telescopic member comprises an elasticity member having a post and a spring embedded therewithin;

the outer telescopic member comprises a plurality of holes in the periphery thereof; and the inner telescopic member and the outer telescopic member are aligned such that the post on the inner telescopic member fits through the holes on the outer telescopic member.

7. The commode aid of claim 1, further comprising a left spreader hinge and a right spreader hinge, wherein the left spreader hinge is configured to connect the left front leg and the left rear leg, and wherein the right spreader hinge is configured to connect the right front leg and the right rear leg, such that the front leg assembly and the rear leg assembly are placed in an open or a closed position.

8. The commode aid of claim 1, wherein the horizontal support brace is substantially U-shaped.

9. The commode aid of claim 1, wherein the horizontal support brace comprises a padded portion.

10. The commode aid of claim 9, wherein the padded portion is configured to be positioned between the toilet seat and the toilet tank and to stabilize the front leg assembly of the commode aid.

11. The commode aid of claim 1, further comprising a left folding stop attached to the left front leg and a right folding stop attached to the right front leg.

12. A commode aid, comprising:

a front leg assembly comprising a left front leg and a right front leg;

a rear leg assembly comprising a left rear leg and a right rear leg;

a left armrest and a right armrest, wherein the left armrest is attached to the left front leg and the left rear leg and the right armrest is attached to the right front leg and the right rear leg;

a horizontal support brace mounted to the left front leg and the right front leg, configured to be positioned between a toilet seat and a toilet tank and to provide support for the front leg assembly of the commode aid;

a knee support, configured to provide protection to knee joints of a user when the knee support is in a horizontal position, wherein the knee support comprises two opposing short edges and two opposing long edges, the two opposing short edges being respectively rotatably attached to the left rear leg and the right rear leg; and a rear support bar attached to the left rear leg and the right rear leg and configured to provide support for the rear leg assembly, wherein the rear support bar further comprises a knee support latching station and the knee support comprises a locking means, and wherein the locking means is configured to engage with the knee support latching station, such that the knee support is secured in an upright position when the knee support is not in use.

13. The commode aid of claim 12, wherein the locking means is a latch, a hook, or a magnet.

14. The commode aid of claim 12, further comprising a left leg support and a right leg support, respectively positioned under the left armrest and the right armrest, wherein each of the left leg support and the right leg support comprises one or more fastening means configured to couple the left front leg and the left rear leg to the left leg support and couple the right front leg and the right rear leg to the right leg support.

15. The commode aid of claim 12, wherein each of the left front leg, the left rear leg, the right front leg, and the right rear leg is adjustable in height and wherein the horizontal support brace is adjustable in length.

16. The commode aid of claim 12, wherein each of the left front leg, the left rear leg, the right front leg, and the right rear leg comprises an inner telescopic member and an outer telescopic member, wherein:

the inner telescopic member comprises an elasticity member having a post and a spring embedded therewithin;

the outer telescopic member comprises a plurality of holes in the periphery thereof; and the inner telescopic member and the outer telescopic member are aligned such that the post on the inner telescopic member fits through the holes on the outer telescopic member.

17. The commode aid of claim 12, further comprising a left spreader hinge and a right spreader hinge, wherein the left spreader hinge is configured to connect the left front leg and the left rear leg, and wherein the right spreader hinge is configured to connect the right front leg and the right rear leg, such that the front leg assembly and the rear leg assembly are placed in an open or a closed position.

18. The commode aid of claim 12, wherein the horizontal support brace is substantially U-shaped.

19. The commode aid of claim 12, wherein the horizontal support brace comprises a padded portion.

20. The commode aid of claim 12, further comprising a left folding stop attached to the left front leg and a right folding stop attached to the right front leg.

* * * * *